United States Patent [19]

Zedrosser

[11] Patent Number: 4,949,493

[45] Date of Patent: Aug. 21, 1990

[54] FIREARM

[75] Inventor: Ulrich Zedrosser, Steyr, Austria

[73] Assignee: Steyr-Daimler-Puch AG, Vienna, Austria

[21] Appl. No.: 404,080

[22] Filed: Sep. 7, 1989

[30] Foreign Application Priority Data

Sep. 23, 1988 [AT] Austria ..... 2351/88

[51] Int. Cl.[5] ..... F41A 3/10

[52] U.S. Cl. ..... 42/15; 42/25; 42/39.5

[58] Field of Search ..... 42/15, 39.5, 25; 89/33.03, 155, 9

[56] References Cited

U.S. PATENT DOCUMENTS

| | | | |
|---|---|---|---|
| 829,779 | 8/1906 | Hagen | 42/395 |
| 3,474,560 | 10/1969 | Ramsey | 42/395 |
| 3,667,147 | 6/1972 | Goldin et al. | 42/15 |
| 4,739,570 | 4/1988 | Zedrosser | 42/15 |
| 4,760,663 | 8/1988 | Zedrosser | 42/15 |

*Primary Examiner*—Stephen C. Bentley
*Assistant Examiner*—Michael J. Carone
*Attorney, Agent, or Firm*—Marmorek, Guttman & Rubenstein

[57] ABSTRACT

A firearm comprises a chamber member, which is separate from the barrel and defines a chamber and which in a firing block, which is fixed to the receiver, is reciprocable between a firing position and a loading position in a direction which is transverse to the longitudinal direction of the barrel. When the chamber member is in its loading position its chamber is freely accessible and at one end communicates through a loading opening of the firing block with the interior of a magazine holder and at the other end communicates through an ejection opening of the firing block with an ejection shaft. For the performance of the loading and unloading operation, a slider is provided, which is movable in the longitudinal direction of the barrel and carries a feeder, which is movable from a first end position, in which the feeder is disposed on that side of the magazine holder which is opposite to the firing block, past said magazine holder toward the firing block as far as into the loading opening of said block.

In order to ensure that the unloading operation will reliably be performed without a disturbance, the ejecting opening of the firing block has an edge portion which faces the chamber member when the latter is in its firing position and the firing block is provided in that edge portion with an ejecting nose, which is spaced from the inner edge of said edge portion and which merges into a deflecting surface, which is convexly curved from said inner edge to said nose, said nose protrudes as far as to the level of the adjacent inside surface of the chamber when the chamber member is in its loading position, and the movement of the chamber member from its loading position to its firing position is adapted to be initiated before the feeder reaches that end position in which the feeder extends into the loading opening.

4 Claims, 1 Drawing Sheet

FIREARM

BACKGROUND OF THE INVENTION

1. Field of the Invention

This invention relates to a firearm comprising a chamber member, which is separate from the barrel and defines a chamber and which in a firing block, which is fixed to the receiver, is reciprocable between a firing position and a loading position in a direction which is transverse to the longitudinal direction of the barrel, wherein when the chamber member is in its loading position its chamber is freely accessible and at one end communicates through a loading opening of the firing block with the interior of a magazine holder and at the other end communicates through an ejection opening of the firing block with an ejection shaft, also comprising a slider, which is movable in the longitudinal direction of the barrel and carries a feeder, which is movable from a first end position, in which the feeder is disposed on that side of the magazine holder which is opposite to the firing block, past said magazine holder toward the firing block as far as into the loading opening of said block.

2. Description of the Prior Art

Such firearms are known, e.g., from U.S. Pat. No. 3,667,147 and owing to their chamber members, which are separate from the barrel and define a chamber, permit relatively simple and functionally reliable loading and firing operations because by the loading operation each cartridge can be inserted by the feeder along a direct, straight path from the magazine in the magazine holder through the loading opening into the chamber of the chamber member when the latter is in its loading position and the loaded chamber member is subsequently moved to its firing position, in which the cartridge is fired to discharge the round. But firearms provided with such chamber members must not only be loaded but also unloaded when the chamber member is in its loading position and empty cartridge cases or cartridges which have not been fired owing to stoppages, duds and the like must also be removed from the chamber when the chamber member is in its loading position. This is due to the fact that an unloading is effected in that a new cartridge is inserted into the chamber so that the new cartridge suitably acts also as an ejector and as it enters the chamber forces the cartridge case or the like which is contained in the chamber out of the latter into an adjoining ejection shaft when a spring-loaded shutter flap has been pushed open. The cartridge case is then expected to fall out of the ejection shaft only by gravity. But that ejecting operation will involve the occurrance of an excessively large number of disturbances so that the known firearms of the kind described last are mainly intended for caseless ammunition and the ejecting mechanism will be used only for an ejection of duds. Besides, the shutter flap and the associated mechanism is liable to be deranged, and the known feeder, which serves to eject the cartridge cases when the magazine has been removed and is slidably mounted on the known feeder, which is slidably mounted on an ejector rod and adapted to be pushed back against spring force, is an expensive part of the slider and considerably adds to its overall length. The ejector rod serves to eject cartridge cases when the magazine has been removed.

SUMMARY OF THE INVENTION

For this reason it is an object of the invention to eliminate said disadvantages and to provide a firearm which is of the kind described first hereinbefore and comprises an ejecting mechanism which is simple, robust and functionally reliable.

That object is accomplished in accordance with the invention in that the ejecting opening of the firing block has an edge portion which faces the chamber member when the latter is in its firing position and the firing block is provided in that edge portion with an ejecting nose, which is spaced from the inner edge of said edge portion and which merges into a deflecting surface, which is convexly curved from said inner edge to said nose, said nose protrudes as far as to the level of the adjacent inside surface of the chamber when the chamber member is in its loading position, and the movement of the chamber member from its loading position to its firing position is adapted to be initiated before the feeder reaches that end position in which the feeder extends into the loading opening. By the advance of the feeder, a new cartridge will be pushed out of the magazine, which is held by the magazine holder, into the chamber of the chamber member, which is held in its loading position, the empty cartridge case or the unfired cartridge can freely be ejected from the chamber into the ejection shaft without an obstruction presented by a shutter flap or the like. But the chamber member begins to move toward its firing position already during the loading and unloading operations so that the relative displacement of the firing block and the firing chamber will have the result that the ejected cartridge case or the like will be engaged adjacent to the ejection opening and owing to the torque which is thus exerted will be tilted down about the ejecting nose into the ejection shaft. The guiding surface will then guide the base of the cartridge case so that the cartridge case or the like will be thrown off at the end of the ejecting movement and that empty cartridge case will positively be ejected through the ejection shaft. The forcible ejection of the cartridge case will be effected regardless of the position and attitude of the firearm and will reliably be performed without a disturbance. The specific manner in which the slider, the feeder and the chamber member cooperate or in which the movement is imparted to the chamber member will not be significant, provided that the initial phase of the movement of the chamber member from its loading position to its firing position and the final phase of the movement which is to be imparted to the feeder for the performance of the loading and unloading operation will overlap for a short time so that the desired ejecting impulse will be imparted to the ejected cartridge case by the chamber member as the latter begins its movement. Owing to the cooperation with the guiding surface and the ejecting nose that ejecting impulse will automatically result in the forcible ejection of the cartridge case. The feeder may consist of a rigid, short coupling finger, which is provided in the slider, so that the loading and unloading operation can be performed by the action of simple, robust and space-saving components.

The tilting of the ejected cartridge case or the like can further be facilitated if the ejecting opening is defined by a convexly rounded edge portion on that side which is nearer to the chamber member in its firing position. In that case the cartridge case will virtually roll on that edge portion as the cartridge case is tilted and there will be no edge portion which might adversely affect the ejection.

It will also be desirable if the loading opening is defined by an inwardly flaring surface on that side which is remote from the chamber member in its firing position. When the movement of the chamber member toward the firing position begins, that flaring surface will provide for the new cartridge, which still somewhat protrudes from the chamber, a free space through which that cartridge can properly be completely inserted into the chamber and the inserting movement will be assisted by a wedge action.

In a particularly desirable embodiment of the invention the slider comprises an ejector rod, which is parallel to the barrel and is directed oppositely to the feeder and is adapted to be telescopically compressed against spring force and when the chamber member is in its loading position and the feeder is returning to its first end position from its second end position close to the loading opening said ejector rod will move through the ejection opening into the chamber. When the magazine has been removed from the firearm, the empty cartridge case which is contained in the chamber can be ejected through the magazine holder by said ejector rod. During the usual unloading operation that ejector rod owing to its resilient backing action will additionally support the cartridge case as it is tilted and ejected. Because the ejector rod is resiliently yieldable, it will not adversely affect the movement of the slider, regardless of whether or not the ejector rod can actually move into the chamber.

A desirable design will be obtained if the ejection shaft is disposed in front of and the magazine holder is disposed behind the magazine holder and the loading and unloading operation will be effected by the slider as it is moved forwardly.

DETAILED DESCRIPTION OF THE PREFERRED EMBODIMENT

Figure 1:
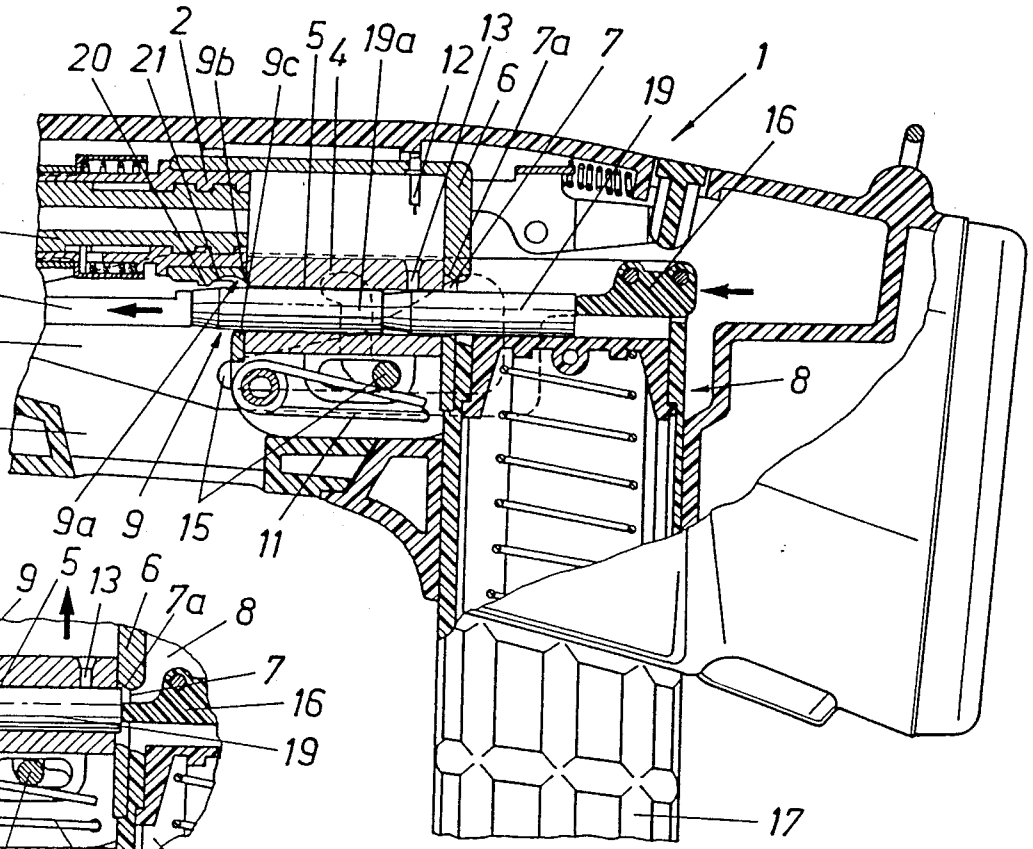
FIG. 1 is a fragmentary side elevation showing partly in section a portion of a firearm in accordance with the invention during the initial phase of the loading and unloading operation.

An illustrative embodiment of the invention is shown on the drawing.

A diagrammatically indicated firearm 1 comprises a receiver 2 and a barrel 3 as well as a separate chamber member 4, which in its interior defines a chamber 5. In a firing block 6, which is fixed to the receiver, the chamber member 4 is reciprocable transversely to the longitudinal direction of the barrel between an upper or firing position, in which a round is discharged, and a lower or loading position, in which the loading and unloading operation can be performed. In the firing position, not shown, the chamber 5 is coaxial to the barrel 3. In the illustrated loading position the chamber 5 is freely accessible and at one end communicates through a loading opening 7 of the firing block 6 with the interior of a magazine holder 8 and at the other end communicates through an ejection opening 9 of the firing block 6 with an ejection shaft 10. The chamber member 4 is movable from its loading position in a loading portion of the firing block 6 to its firing position in a firing portion of the fixing block 6 by a spring drive 11. As the chamber member 4 arrives in its firing position, a firing pin 12 fixed in the firing block 6 enters the chamber 5 through a firing bore 13 of the chamber member 4 to fire the cartridge which is contained in the chamber 5. The return movement from the firing position to the loading position is imparted to the chamber member 4 by a slider 14, only the forward end portion of which is shown and which is movable in the longitudinal direction of the barrel. During its rearward movement, the slider 14 operates a cam mechanism 15 to return the chamber member 4 to its loading position against the force of the spring drive 11 and to lock the chamber member 4 in its loading position. At the end which faces the magazine holder the slider 14 carries a feeder 16, which by a forward movement of the slider 14 is advanced from a first end position behind the magazine holder 8 past said holder 8 into the loading opening 7 of the firing block 6. The slider 14 is provided at its rear end with an ejector rod 18, which is directed oppositely to the feeder 16 and which is supported by means which are not shown so that the ejector rod can be telescopically compressed against spring force.

The firearm 1 can be loaded and unloaded when the chamber member 4 is in its loading position, in which the chamber 5 is freely accessible from the magazine holder 8 and from the ejection shaft 10. The slider 14 is in its rear position and the feeder 16 is in its rear or first end position. If a magazine 17 has been inserted into the magazine holder 8, a forward movement of the slider 14 will cause the feeder 16 to push a cartridge 19 out of the magazine 17 through the loading opening 7 of the firing block 6 into the chamber 5. If an empty cartridge case **19*a* or an unfired other cartridge is contained in the chamber 5 at that time, the new cartridge 19 will force that cartridge case 19*a* or the like through the ejection opening 9 out of the chamber 5. If there is no cartridge case 19*a* in the chamber 5, the new cartridge 19 will be advanced into the empty chamber and the ejector rod 18** will be retracted out of the chamber at the same time.

Figure 2:
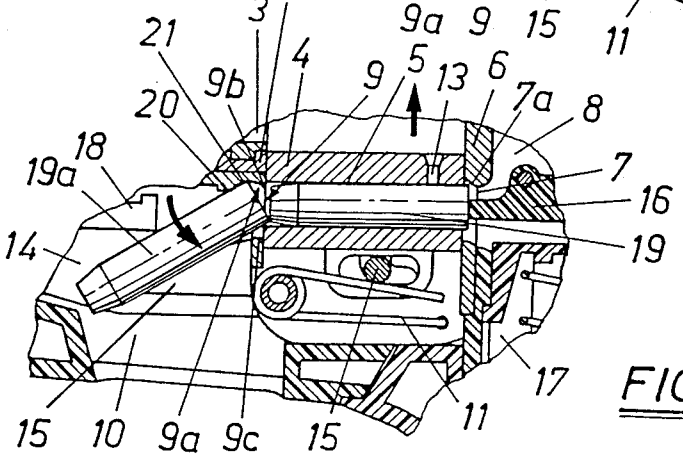
FIG. 2 shows a portion of FIG. 1 and illustrates the end phase of that loading and unloading operation.

The chamber member 4 is at a standstill (FIG. 1) during a major part of the time in which the new cartridge 19 is inserted into the chamber 5 and the cartridge case **19*a* is pushed out of the chamber 5. In order to ensure a forcible ejection of the cartridge case 19*a*, the operation of the spring drive 11 is initiated shortly before the insertion of the cartridge 19 into the chamber and the ejection of the cartridge case 19*a* out of the chamber 5 have been completed. As a result, the chamber member 4 begins to rise when an end portion of the cartridge case 19*a* still protrudes through the ejection opening 9 into the chamber 5. A tilting moment will then be exerted on the cartridge case 19*a* because adjacent to the top edge portion 9*a* of the ejection opening the firing block 6 is formed with an ejecting nose 20 and with a deflecting surface 21, which has a concave curvature from the ejecting nose 20 to the inner edge 9*b* of the top edge portion 9*a* (FIG. 2). The ejecting nose 20, which terminates on the level of the top inside surface of the chamber, and the concave deflecting surface 21 cooperate to ensure that the overlapping of the ejecting movement of the cartridge case and the rising movement of the chamber 4 will not result in a clamping of the cartridge case 19*a* in the ejection opening and that the cartridge case 19*a* will be tilted into and ejected through the ejection shaft 10 so that a proper and troublefree unloading will be effected. The tilting of the cartridge case 19*a* will be assisted by the resiliently yieldable ejector rod 18 and will be facilitated by a convexly curved edge portion 9c, which defines the ejection opening 9 on the side which is nearer to the firing portion. In order to ensure that the new cartridge 19 will completely be inserted into the chamber 5 after the chamber member 4 has begun to move, the loading opening 7 is defined by inwardly flaring surface 7a on the side which is nearer to the firing portion so that said flaring surface will engage the cartridge 19 and will force the cartridge 19 exactly to its desired position in the chamber 5 as the chamber member 4** is rising.

When the magazine 17 is empty or has been removed, the unloading will be effected by the ejector rod 18. During the rearward movement of the slider 14 the ejector rod 18 engages the chamber member 4 and is prestressed until the chamber member has reached its loading position. Thereafter the ejector rod 18 under its spring bias enters the chamber 5 so that any cartridge case then contained in the chamber 5 will be ejected through the loading opening 7 and the magazine holder 8 and an unloading will thus be performed even when a new cartridge is not being inserted.

I claim:

1. In a firearm comprising a receiver, a barrel, which is fixed to said receiver and extends forwardly from said receiver in a longitudinal direction, a firing block, which is fixed to said receiver and comprises a firing portion and a loading portion, which are offset from each other transversely to said longitudinal direction, a hollow magazine holder, which is provided on said receiver at one end of said firing block, a downwardly open ejection shaft, which is provided in said receiver at the other end of said firing block, said firing block being formed in its loading portion with a loading opening, which communicates with the interior of said magazine holder, said firing block being formed in its loading portion with an ejection opening, which is aligned with said loading opening in said longitudinal direction and communicates with said ejection shaft, said firearm also comprising a chamber member, which has an inside surface portion that defines in said chamber member a chamber on the side that is remote from said firing portion, said chamber member being mounted in said firing block to be reciprocable between a firing position in said firing portion and a loading position in said loading portion, wherein said chamber is arranged to be freely accessible and to communicate through said loading opening with the interior of said magazine holder and through said ejection opening with said ejection shaft when said chamber member is in said loading position, drive means are provided, which are operable to impart to said chamber member a movement from said loading position to said firing position, said firearm also comprising a slider, which carries a feeder, which protrudes in said longitudinal direction toward said firing block and is aligned with said loading opening in said longitudinal direction, wherein said slider is mounted in said receiver to be reciprocable in said longitudinal direction to move said feeder past said magazine holder between a first end position, in which said feeder is disposed on that side of said magazine holder which is opposite to said firing block, and a second end position, in which said feeder extends into said loading opening, the improvement residing in that said firing block is provided in said loading portion with an edge portion which defines said ejection opening on the side thereof which is remote from said firing portion and has an inner edge and is provided with an ejecting nose that is spaced from said inner edge in said longitudinal direction and protrudes toward said firing portion and is arranged to terminate on the level of said inside surface portion when said chamber member is in said loading position, said edge portion is formed between said nose and said inner edge with a deflecting surface, which is convexly curved from said inner edge to said nose, and control means are provided for initiating said movement of said chamber member by said drive means from said loading position to said firing position in response to a movement of said slider in said longitudinal direction toward said second end position before said slider has arrived in said second end position.

2. The improvement set forth in claim 1, wherein said firing block is formed in said loading portion with a concavely convexly rounded edge portion which defines said ejection opening on the side thereof which is nearer to said firing portion.

3. The improvement set forth in claim 1, wherein said firing block is formed in said loading portion with an edge portion which defines an inwardly flaring portion of said loading opening on the side thereof which is nearer to said firing portion.

4. The improvement set forth in claim 1, wherein said ejection shaft is disposed in front of said firing block and said magazine holder is disposed behind said firing block.

* * * * *